US008077034B2

(12) United States Patent
Borlez et al.

(10) Patent No.: US 8,077,034 B2
(45) Date of Patent: Dec. 13, 2011

(54) SENSOR FOR PRESENCE DETECTION

(75) Inventors: Yves Borlez, Heure-Le-Romain (BE); Olivier Gillieaux, Blegny (BE); Christian Leprince, Sprimont (BE)

(73) Assignee: BEA SA, Angleur (BE)

( * ) Notice: Subject to any disclaimer, the term of this patent is extended or adjusted under 35 U.S.C. 154(b) by 427 days.

(21) Appl. No.: 12/443,181

(22) PCT Filed: Sep. 28, 2006

(86) PCT No.: PCT/EP2006/009441

§ 371 (c)(1),
(2), (4) Date: Jun. 2, 2009

(87) PCT Pub. No.: WO2008/037282

PCT Pub. Date: Apr. 3, 2008

(65) Prior Publication Data

US 2010/0039217 A1 Feb. 18, 2010

(51) Int. Cl.
*G08B 13/18* (2006.01)

(52) U.S. Cl. ..... 340/552; 340/545.1; 340/545.2; 340/545.3; 340/557; 340/5.7; 348/143

(58) Field of Classification Search ..... 340/552, 340/545.1, 545.2, 545.3, 557, 565, 541, 5.7, 340/551, 545.9, 567; 49/26, 28; 318/364; 356/5.01, 4.01, 4.1, 4.06, 623; 250/559.31, 250/559.29, 559.38, 206.1, 208.2; 348/143, 348/E7.85

See application file for complete search history.

(56) References Cited

U.S. PATENT DOCUMENTS

| | | | | |
|---|---|---|---|---|
| 5,838,428 | A | 11/1998 | Pipitone et al. | |
| 6,700,542 | B2 | 3/2004 | Borlez et al. | |
| 6,756,910 | B2 * | 6/2004 | Ohba et al. | 340/686.6 |
| 6,791,461 | B2 * | 9/2004 | Oku et al. | 340/573.1 |
| 7,129,892 | B2 | 10/2006 | Borlez et al. | |
| 7,154,112 | B2 | 12/2006 | Eubelen et al. | |
| 7,349,074 | B2 | 3/2008 | Zambon | |
| 7,362,224 | B2 | 4/2008 | Zambon | |
| 7,397,929 | B2 * | 7/2008 | Nichani et al. | 382/103 |
| 7,446,862 | B2 | 11/2008 | Zambon | |
| 7,495,556 | B2 | 2/2009 | Eubelen et al. | |
| 2003/0193157 | A1 | 10/2003 | Uomori | |
| 2004/0105580 | A1 | 3/2004 | Hager | |

FOREIGN PATENT DOCUMENTS

| | | |
|---|---|---|
| EP | 1528411 A1 | 5/2005 |
| EP | 2008037282 | 3/2008 |
| WO | 8202787 | 8/1982 |
| WO | 2008037282 | 4/2008 |

* cited by examiner

*Primary Examiner* — Anh V La
(74) *Attorney, Agent, or Firm* — Woodling, Krost and Rust

(57) ABSTRACT

The invention refers to a sensor (10) for presence detection, and a method for presence detection, in a detection area (18) comprising at least an image generator (14) for generating an image on a detection area (18) formed by illuminated structures reflecting from said detection area (18), a detector (20) for detecting signals of the image reflected from the detection area (18), an image processing unit (24) for comparing the signals based on the reflected and received image with signals of a reference image stored in storing means of the image processing unit (24), wherein the image generator (14) generates a pattern (16) on the detection area (18) having illuminated and non-illuminated zones, the image processing unit (24) uses triangulation technique to detect changes of the pattern (16) within the detection area (18) over the reference image.

20 Claims, 6 Drawing Sheets

SENSOR FOR PRESENCE DETECTION

Figure 1A:
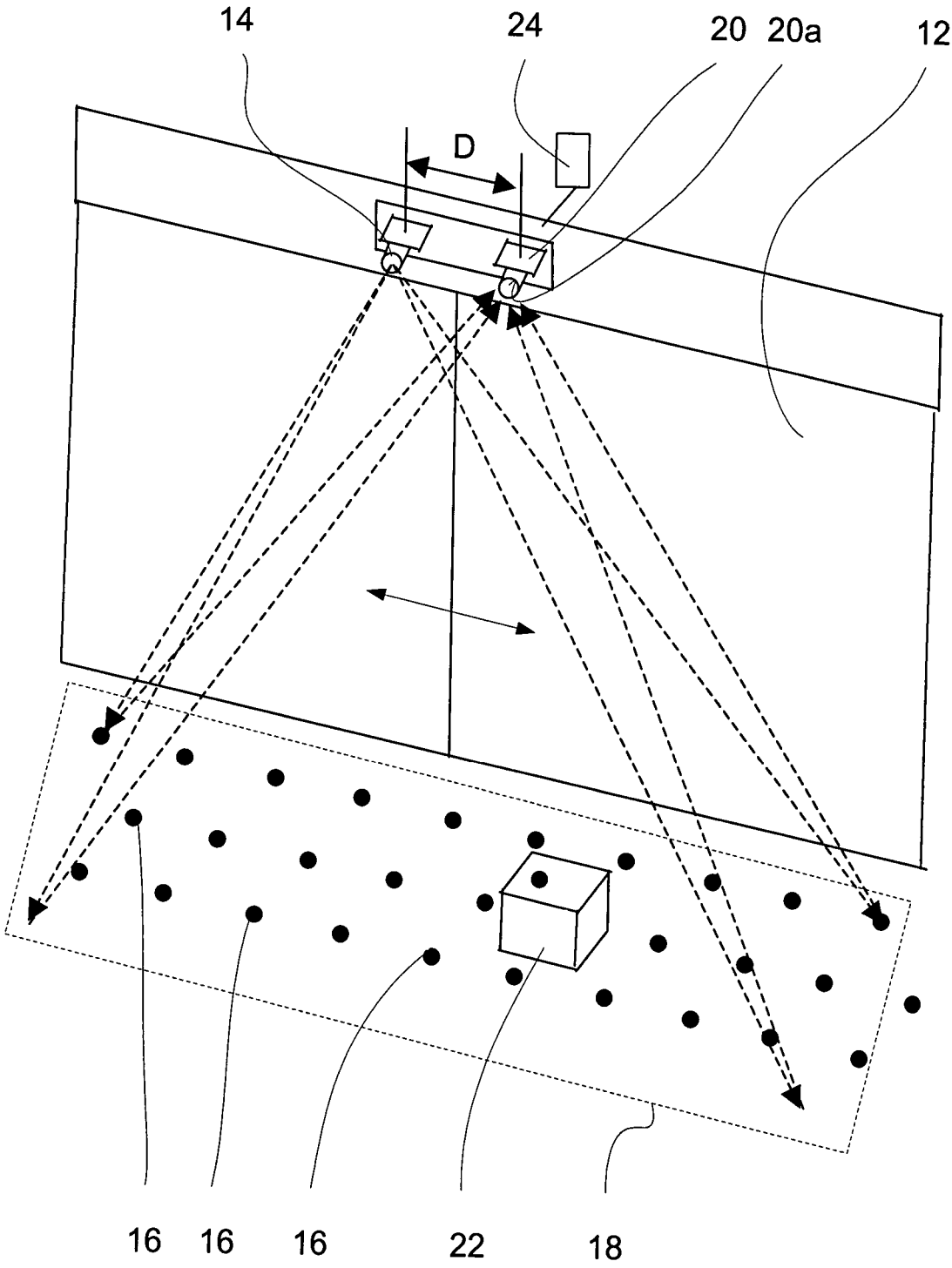

The invention relates to a sensor for presence detection.

Sensors and methods for presence detection are known in different techniques and embodiments.

It is known to use cameras, which are usually a preferred choice when it comes to the detection of a wide area. They can cover with the appropriate optics the required area. Normal video cameras suffer from a lot of different limitations that are causing problems in an automatic door environment.

A first problem is the illumination problem. The camera is strongly dependent on the light that is used to illuminate the scene and in case of dark conditions, it can lead to absence of detection. To compensate for that, it is then often required to have an auxiliary illumination device to provide the necessary light.

A second limitation of cameras is linked to the need for rapid adaptation of the camera shutter in case of abrupt changes of illumination, as can happen for example when the door opens and the sun suddenly reaches the interior detection area. There can be a blooming effect that would blind the camera for a while.

A third limitation of the classical camera system is linked to the projection of shadows or lights on the ground. These can be detected as being real targets and this would generate false detection. So, the camera cannot make the difference between a true volume and a modification of the ground. When an element such as a leave, water or a sheet of paper is placed on the ground, it would be detected as a variation of the ground image. It is also important to add that the video signal processing is quite resource-consuming and requires powerful digital signal processors to make the image analysis. This has a negative impact on the costs of such a sensor.

Furthermore, infrared reflection sensors are also well known from the state of the art. According to this technique a set of infrared—IR—spots are projected on the ground. The infrared reflection sensor analyzes then the amount of energy that is received back on corresponding photodiodes. This principle has the advantage of being "active", which means that the detection is based on the analysis of a transmitted signal, as opposed to a video camera that is "passive" in the sense that it only looks at the light that is received without sending any energy onto the ground. The active sensors are more immune to ambient light, because, by filtering, it is possible to look only at the received signal coming from this transmission. Well known limitations of these reflection sensors are also the sensitivity to ground variations.

A further active sensor is known from EP 1 528 411 wherein an infrared triangulation sensor is disclosed. This sensor works as a distance measurement sensor and comprises at least two optoelectronic signal sources for projecting at least two spots on a target, an optoelectronic receiver, an optics for reproducing the at least two spots on the optoelectronic receiver, and means for processing the output signals generated by the optoelectronic receiver and for controlling the at least two optoelectronic signal sources depending on the processed output signals in order to measure the distance between the target and the sensor by a triangulation technique.

By using more than one optoelectronic signal sources and a position sensitive detector—PSD—, it is possible to provide more than one detection spot and their corresponding distance thresholds. In other words, for every optoelectronic signal source corresponding to one detection spot, a desired distance threshold is provided. By processing the output signals of the optoelectronic receiver and respective controlling of the optoelectronic signal sources, it is possible to use more than one spots for distance detection. Unfortunately, the number of spots is rapidly limited by the accuracy of the PSD detector and its size.

The triangulation principle is based on the measurement of an angle made between a source, a target and a detector. The distance between the target and the source modifies the angle. The advantages of these sensors are a higher immunity to the ambient lights as well as immunity to the ground variations. However, these sensors have a limited number of detection spots. Furthermore, the structure of the ground of the detection area influences the results of theses sensors.

It is, therefore, an object of this invention to provide a sensor and a method for presence detection in order to overcome the above noted disadvantages, to provide a low cost detection system that can cover a rather large area where it is required to detect the presence or not of a target while being insensitive towards environmental influences to ground variations, ambient light illumination and any type of shadows or projected lights into the detection area.

These as well as other objects of the present invention are accomplished generally through a sensor for presence detection disclosed herein.

The invention is based on the idea to use the triangulation method for a presence detection sensor wherein the sensor comprises at least an image generator generating an illuminated image on a detection area and a detector to detect the change of the illuminated image form of a pattern with the help of the triangulation method. Finally, the sensor detects the distortion of the image projected on the ground in the detection area. Thus, the method is based on triangulation measurement of a pattern projected on the ground by at least a light source such as a laser and additional diffractive elements and analyzed by a camera whose shutter is synchronized on the reception of the pattern. This allows removing the influence of ambient illumination.

According to the invention, a sensor for presence detection in a detection area is provided which comprises at least an image generator for generating an image on a detection area formed by illuminated structures reflecting from said detection area, a detector for detecting signals of said image reflected from said detection area, an image processing unit for comparing said signals based on said reflected and received image with signals of a reference image stored in storing means of the image processing unit, wherein said image generator generates a pattern on said detection area having illuminated and non-illuminated zones, said image processing unit uses triangulation technique to detect changes of the pattern within the detection area over the reference image. This sensor is more insensitive over ambient light and other influences of the detection areas, as the known sensors of the state of the art.

In compliance with a first embodiment of the invention said image generator and said detector have a predetermined distance (D) to each other. Over the distance the angle for the triangulation analysis is fixed. This angle has to be a predetermined dimension that the resolution for the detection of changes of the angle are easy to detect. The detection distance range and accuracy depends on the distance between the image generator and the detector and the detector resolution.

For analyzing the projected image in the detection area said detector comprises an optoelectronic receiver, especially a camera, which is preferably provided with a CCD or a CMOS chip.

To broaden the application possibilities of the sensor, said camera has a shutter which is externally controllable.

According to one embodiment of the invention said image generator generates said image as a fixed image or a pulsed image so that the image is generated within predetermined interruptions.

Especially a control unit can be provided, and said shutter and said image generator can be controlled by said control unit to synchronize the opening of the shutter with the pulse frequency of said image generator to open the shutter with the beginning of the image pulse and to close the shutter in dependency of the end of the image pulse. Thus, the relative contribution of the pulsed IR energy over ambient light can be further enhanced by the higher peak IR power transmitted, while keeping mean power acceptable. The influence of ambient light on the image can then be further reduced.

Preferably said detector comprises an optical input filter to minimize the influence of ambient light on the detection of the change of the pattern.

According to a further embodiment of the invention said pattern generated by the image generator comprises at least one spot, especially a rectangular dots grid or a shifted dots grid, and/or at least one line, especially parallel lines, preferably in regular distances to each other, or a line grid.

Especially the image generator comprises a light source and especially a beam shaper. Said light source generates wavelength from 400 to 960 nm, especially from 780 to 850 nm.

According to a further embodiment of the invention said pattern can be generated by a set of single spot light sources that are positioned over the required protected area, wherein each source is in a particular distance to the detector. This distance might vary from one source to the other.

Furthermore, said light source can be a high power pulse laser or an LED source.

Said beam shaper can be of the group of diffractive optics, micro lenses arrays, conventional anamorphic optics like for example cylindrical lenses.

Preferably, a multitude of image generators are provided, wherein each is in a particular location and orientation relative to the detector.

According to the invention the method for presence detection in a detection area has the steps wherein at least one image generator generates a pattern on the detection area having illuminated and non-illuminated zones, a detector detects the image on the detection area and generating output signals, an image processing unit compares said output signals based on the reflected and received image with signals of a reference image stored in storing means of the image processing unit using triangulation technique to detect the changes of the pattern within the detection area over the reference image.

Especially a pulsed image is projected on the detection area.

Preferably a shutter of the detector is opened if the pulsed image is projected on the detection area.

According to a further embodiment of the method of the invention a first detection step is performed during the image on the detection area and a second detection step is performed if the pulsed images are no longer projected on the detection area.

Said image processing unit can compare the results from the first and the second detection step to filter out the ambient influence on the detection area. This result can be accumulated over several cycles to enhance the ambient light rejection. Either the comparison will take place between several accumulated images of the first detection step and several accumulated images of the second detection step or there will be several accumulations of differences calculated between subsequent first and second detection steps.

According to a further embodiment of the method of the invention, the duty cycle of the transmit period can be set to maximize source peak power and minimize the ambient light integration time, avoiding saturation of camera pixels by ambient light and increasing signal to noise ratio.

Especially, said detection area corresponds to a part or the whole field of view of a camera of the detector.

Preferably, the sensor starts with an activation step wherein a reference image is stored.

Preferably, the sensor according to the invention or the method according to the invention is used in a automatic door opener and shutter.

Figure 1B:
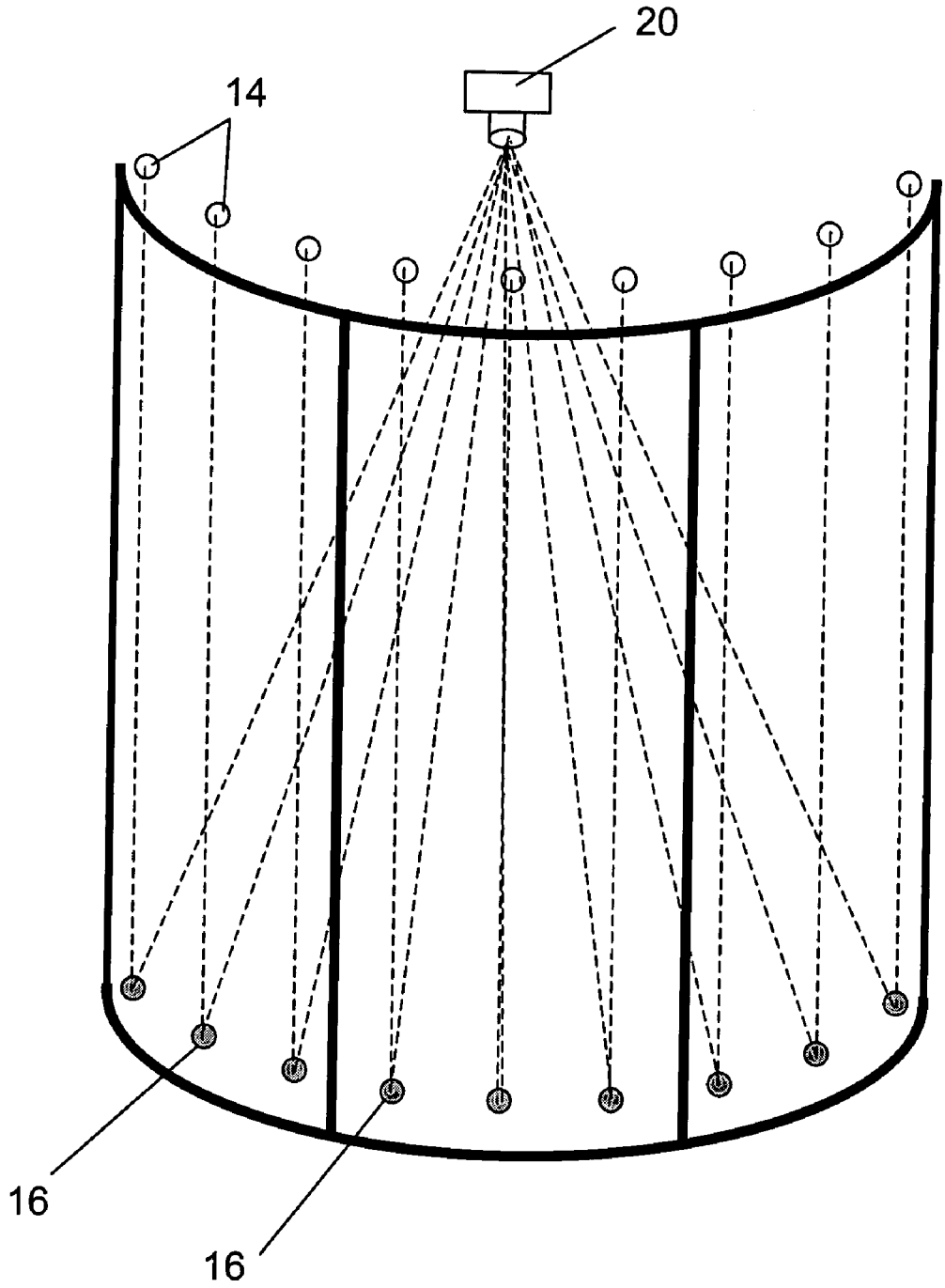
Figure 2:
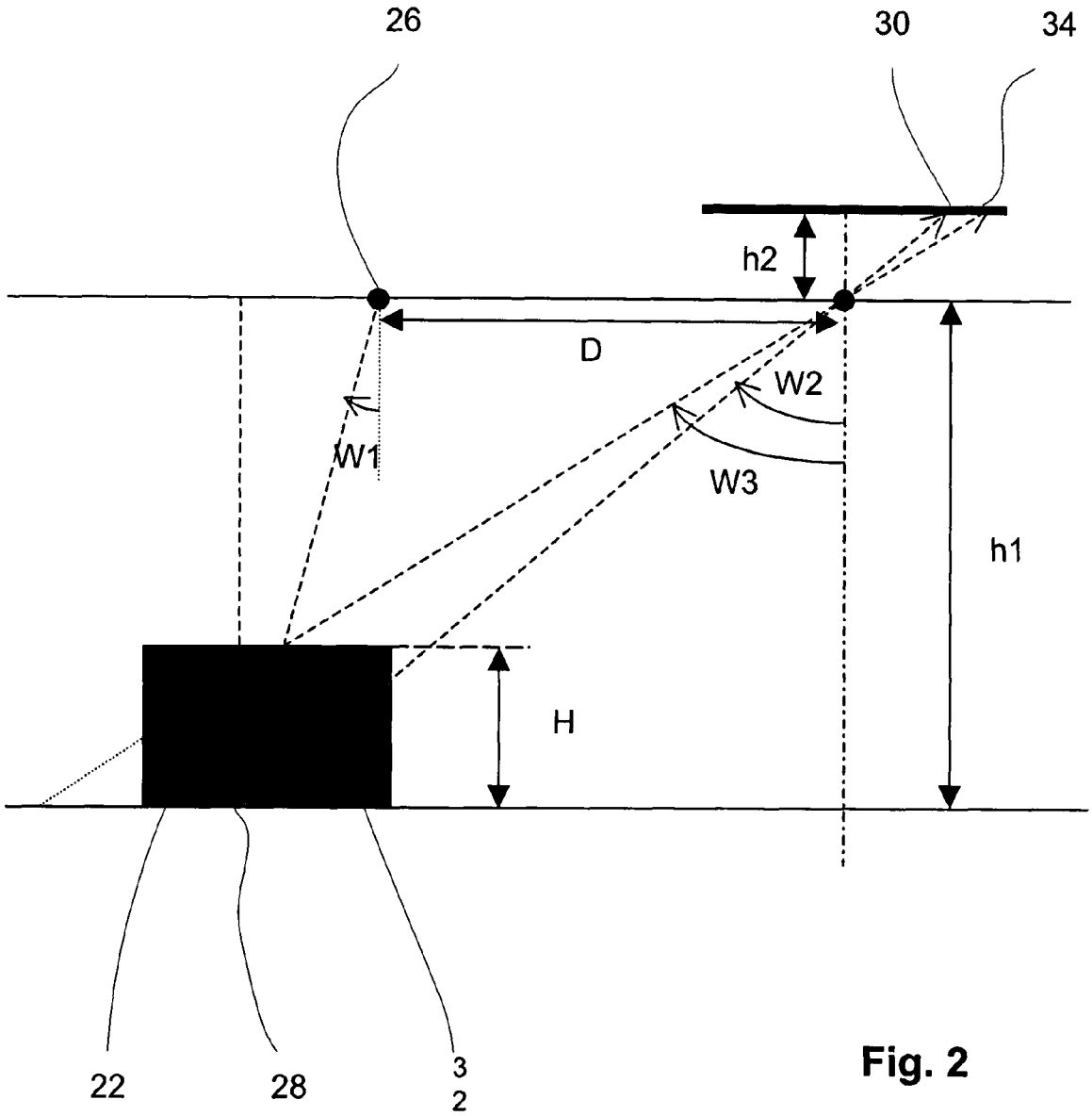
Figure 3A:
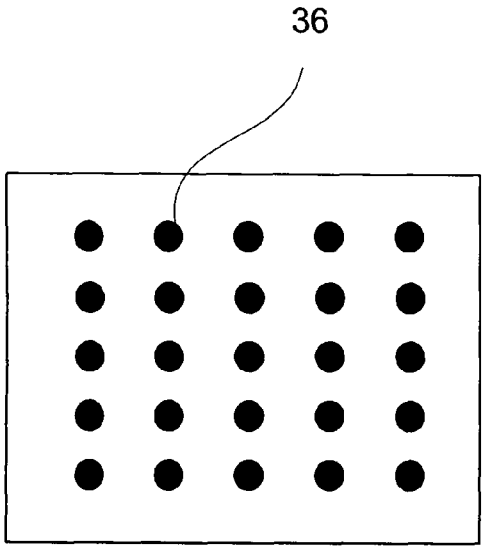
Figure 3B:
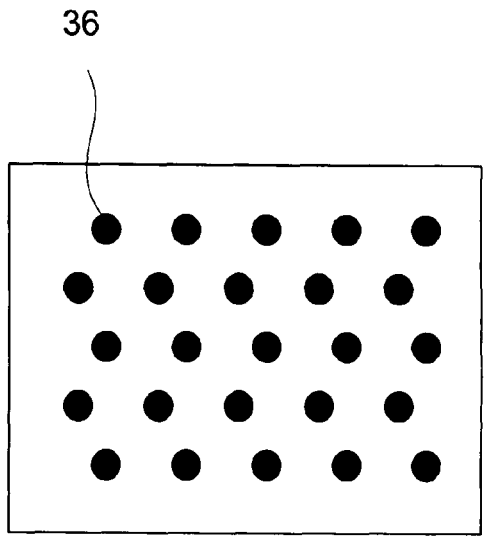
Figure 3C:
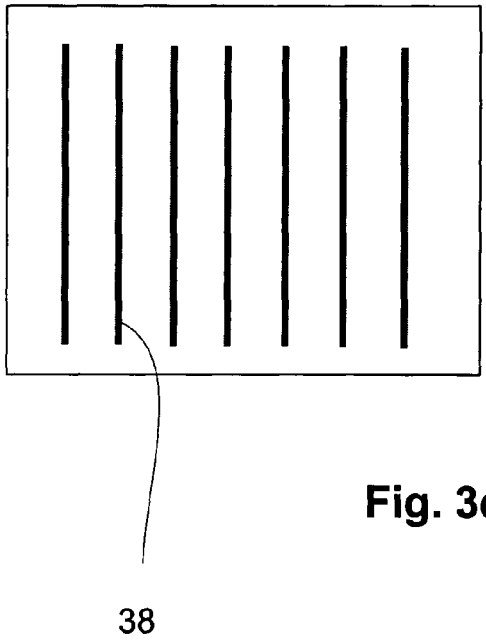
Figure 3D:
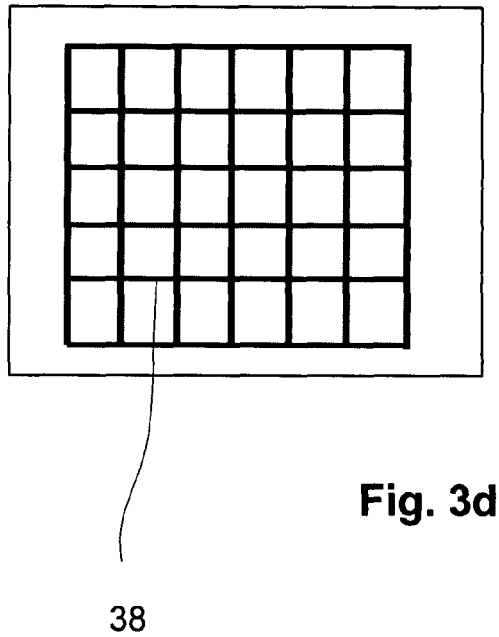
Figure 4:
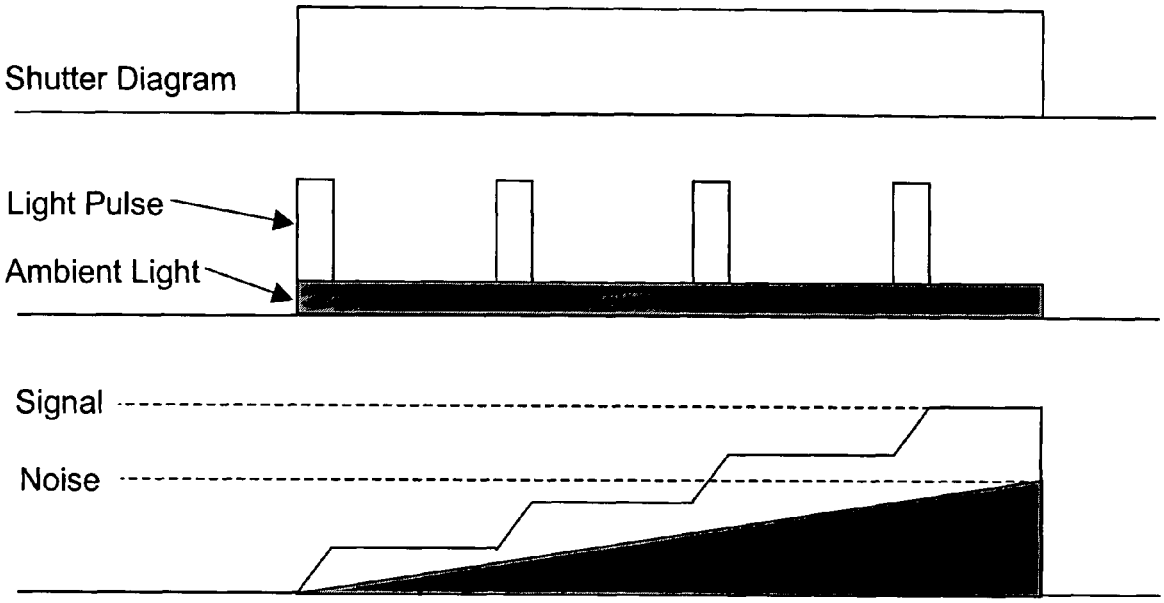
Figure 5:
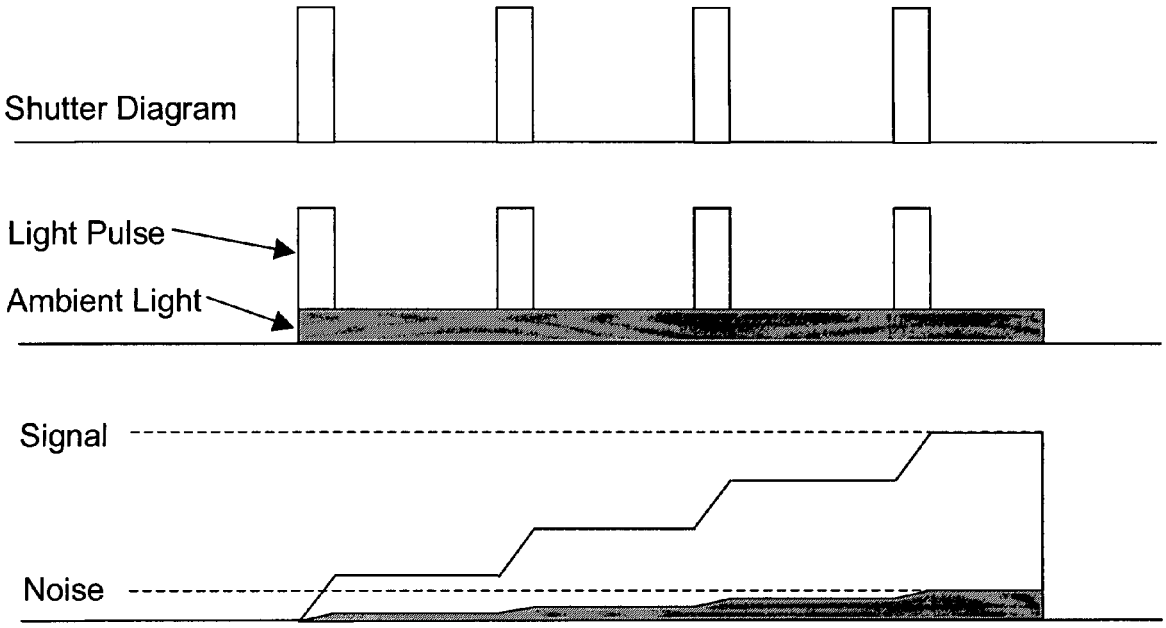

Additional objects, advantages, and features of the present invention will become apparent from the following description taken in conjunction with the accompanying drawings. In the drawings are shown:

FIG. 1*a* an example of the basic measurement principle with a sensor according to the invention with a pattern generator and a camera;

FIG. 1*b* an alternative example of the measurement principle that uses a multiplicity of single point pattern generators positioned over the required protected area and a camera;

FIG. 2 the detection principle of the sensor;

FIG. 3*a* a first example of a pattern of the pattern generator of the sensor;

FIG. 3*b* a second example of a pattern of the pattern generator of the sensor;

FIG. 3*c* a third example of the pattern generator of the sensor;

FIG. 3*d* shows a fourth example of a pattern of the pattern generator of the sensor;

FIG. 4 a diagram showing the signal development with a non-synchronized shutter of the camera, and FIG. 5 a diagram showing the signal development with a synchronized shutter of the camera.

In FIG. 1*a*, a sensor 10 is shown, working together with a door opener and shutter, namely a sliding door 12. Above the sliding door 12 the sensor 10 is arranged to detect a presence of anybody in front of the sliding door 12 in a detection area 18.

An image generator 14 projects a pattern 16—here the points—on the ground of the detection area 18 in front of the sliding door 12. This pattern 16 is observed by a detector 20, namely a camera 20*a*.

The image generator 14 and the detector 20 are separated by a distance D. The detector 20 is designed to detect only the pattern 16 projected on the ground of the detection area 18. The intentional distance D between the image generator 14 and the detector 20 generates a parallax effect. This effect will create a distortion of the pattern 16 as seen by the camera 20*a* when there will be the presence of an object 22 between the ground and, thus, the detection area 18 and the camera 20*a*.

If the ground reflectivity varies, the intensity of the reflected pattern 16 will vary but its shape will not change. This is very desirable in automatic door environments because then the sensor 10 will become immune to any ground reflectivity variations provoked by rain, water, sheets of paper etc.

To achieve this detection, the sensor 10 solves different problems that are described in the following paragraphs.

The detector 20 has an image processing unit 24 which is based on the image analysis of a pattern 16 that is generated and projected on the ground of the detection area 18 from the image generator 14. This pattern 16 is generated from the image generator 14 using the combination of light source, namely a laser 26, and diffractive or non-diffractive elements that will transform the laser beam into the pattern 16.

The image processing unit 24 makes then use of the triangulation principle. This is possible because the camera 20*a* of the detector 20 and the image generator 14, thus, the laser and the diffractive or non-diffractive elements are not concentric. If a pattern 16 is projected on the ground 18, the camera 20 will receive an image of that pattern 16 depending on the relief of the ground. If the ground is plane, there will be quite few distortions on the pattern 16. The presence of a target having a minimum height will automatically distort the pattern 16 as perceived by the camera 20*a*. This is due to the effect of triangulation described below in connection with FIG. 2.

Considering the laser 26, thus the light source, projecting a spot 16*a* on the ground of the detection area 18 at a first position 28, the reflected energy is imaged on the camera 20*a* on the first point 30. When an object 22 of a height H is inserted, the spot 16*a* reflects on the object 22 at the second position 32 and is sent back to the camera 20*a* on a second point 34. The net result is then a shift from the first point 30 to the second point 34. The shift from the first point 30 to the second point 34 is only dependent on the height $h_1$ and $h_2$ of the sensor 10 above the detection area 18, the distance D between the image generator 14 and the detector 20 with the camera 20*a*, the focal length of the camera optics and the height H of the object 22, and, thus, from the angles $W_1$ to $W_3$ arisen. A remarkable result is that it does not depend on the position of the object 22 horizontally. This reasoning can be done for all spots of the projected pattern 16. The result of this is then that such a pattern 16 will be distorted by a shift of the received points according to the distance of each of the points illuminated by the pattern 16.

If the laser 26 and the camera 20*a* would be concentric, the pattern 16 seen by the camera 20*a* would not depend on the distance from the object 22 and then there would be no distortion on the pattern 16, no matter the relief of the scene. But when the camera 20*a* is located at a distance D from the laser 26, this triangulation effect will have as a consequence the distortion of the pattern 16 according to the relief of the ground of the detection 18 and the object 22.

It is also possible to have such an effect if several light sources are used at the same time, like in FIG. 1*b*. In this case, the displacement of the spots will be dependant on the relative positions of each light source of the image generator 14 from the camera 20*a*.

The detection principle is based on the analysis of the pattern 16 that is seen by the camera 20*a* from the ground, taken as reference and the pattern 16 received when an object 22 is present in the detection area 18. When a change of color, subsequent to for example the presence of a sheet of paper on the ground, occurs, the sensor 10 will see the pattern 16 identical and there will be no detection. The sensor 10 will then be insensitive to ground reflectivity variations.

Consequently, according to the invention there is no need to have a true distance measurement for all points of the scene. It is only necessary to make sure that no object 22 is positioned between the sensor 10 and a distance slightly higher than the ground of the detection area 18. It is just needed to detect an object 22 having a minimum size of 20 cm×30 cm×70 cm corresponding to a little child.

In order to properly cover the detection area 18, the pattern 16 needs to be selected carefully. Several possibilities are to be considered. The choice needs to be done on the following criteria:

The pattern 16 formed on the ground of the detection area 18 covers a part or the whole field of view of the camera 20*a*, which form the detection area 18. It should be optimized to maximize chances of object detection.

The difference between the illuminated areas and dark areas should be high to ease the detection of the pattern 16.

In order to minimize the total amount of illumination power, a surface coverage ratio is provided that allows the measurement of points at regular intervals while having no illuminations in between these points. From this, the peak power observed on the illuminated area can be higher while respecting the average and total power limitations. This is an advantage for laser 26 safety regulation constraints.

To minimize the cost of the sensor 10, the pattern 16 is made with a high optical yield, high efficiency and low cost optical element.

In FIGS. 3*a* to 3*d* below are shown some patterns 16 that could be used. Points 36 have the advantage over lines 38 to have a higher spatial duty cycle, because it is available in the two dimensions.

The number of spots and spot spacing are optimized to maximize power/spot while keeping the distance between spots short enough to detect the minimum object 22.

As described above with respect to the state of the art, one advantage of the IR active sensors is their good rejection of ambient light. One key feature of the sensor 10 according to the invention is to make the detector principle become "active". As it is sent energy on the detection area 18 forming a pattern 16, the shutter of the camera 20*a* is synchronized with the image generator 14 to pick up light only when energy is sent on the ground of the detection area 18 from the image generator 14.

To optimize the aim to look only at the pattern 16 without any interference of ambient light like the sun or any artificial light source it is desirable to have an optical input filter on the camera 20*a* that will enhance the pattern 16 and remove the image coming from the normal illumination of the scene.

Furthermore, it is important also to make sure that there is no saturation of the camera pixel at the end of the process.

For that purpose, a pulsed light source will be used, i.e. the laser 26, if the detector 20, thus the camera 20*a*, has a fast shutter. The laser can have a high instantaneous power—several hundred milliwatts—, but with very short pulse duration. The shutter of the camera 20*a* is controlling all the pixels at the same time and opens only during the source pulse duration.

This will reduce the illumination common mode and increase the signal to noise ratio. The ambient illumination image is here obviously considered as noise. The graphs in FIGS. 4 and 5 show how the synchronization of the integration of the light within the shutter time gives such a benefit.

The shorter the pulse duration and respective shutter time, the lower the contribution of the ambient light to the signal will be, avoiding saturation of the camera by ambient light and allowing better ambient light rejection. The synchronization of the laser 26 with the camera 20*a* can be done by the image processing unit 24.

In order to remove the remaining contribution of ambient light in the pixel light integration that is shown as "Noise" in FIGS. 4 and 5, it is suggested to make two measurements. One will be made with the pulses sent to the camera 20*a* and the second one without the pulses.

The camera shutter is open without any source pulse during the same accumulated time than the previous step to have an image of the background. Both images are then subtracted to highlight the pattern image. The sensor 10 is then almost insensitive of background illumination variation.

After the different steps described hereunder, an image of the pattern 16 is available to be processed. This image consists in the received pattern 16 where the illuminated points have been enhanced and were the other points are black.

The intensity of the pattern points might vary due to the reflectivity of the ground, but the detection algorithm will ignore these variations. The only parameter that matters is the position of the points.

A reference image in the absence of an object 22 will then be taken. In detection mode, a comparison will be made between the position of the different spots on the reference image and the position of the spots of the current image. If a spot has moved outside an acceptance region, the detection will occur.

The light source could either be the high power pulse laser 26 or an LED source. It is important that the light source is able to be pulsed and also to be shaped subsequently by the optics to form the appropriate pattern on the ground.

A beam shaper like the mentioned diffractive or non-diffractive optics forms the pattern 16 on the ground of the detection area 18 at a distance of several meters. As an alternative the beam shaper could be micro lenses arrays or conventional anamorphic optics.

The shape of the grid on the ground can be rectangle, square or trapezoid or any other shape.

As mentioned above an optical filter is useful at the input of the camera 20*a* to reject already some part of the ambient light. If a laser 26 is used, its narrow bandwidth allows the use of an interference filter having a narrow bandwidth and a sharp rejection on each side of the useful band. This will already help a lot the rejection of non useful light.

The camera 20*a* has a CCD or a CMOS chip and a global shutter that is controllable externally. The sensitivity of the camera 20*a* will have to be optimized for the Source wavelength.

With the synchronization of the camera shutter with the pulse of infrared generated by the image generator 14 the integration of the ambient light can be minimized and a maximum pattern 16 over ambient light ratio is possible. Furthermore, the pulsed nature of the IR light allows higher peak values while keeping the average power below the safety limits.

The difference of the images based on the comparison of the detection area with a pattern 16 and without a pattern allows the rejection of the ambient light over the useful pattern. This difference can be accumulated over several cycles to enhance further the signal to noise ratio of the image.

The use of a laser 26 in conjunction with a diffractive or non-diffractive beam shaper can provide the pattern 16 on the ground of the detection area 18 with a high resolution. The spatial repartition of the energy can be designed to maximize the ratio between the illuminated and non illuminated zones. Ideally, the point pattern 16 seems to be the most appropriate because it maximizes the difference between the pattern areas and the non-illuminated areas, while making sure that an appropriate coverage of the detection zone is done for a body having a minimum size. For example, if the points are 15 cm apart from each other, the detection of a body of 20 cm×30 cm×70 cm is not a problem. When the image processing unit 24 processes the pattern 16 as being "white over a black background" the image is then be easily digitized into only "1" or "0" per pixels. Furthermore, the extreme simplicity of the image obtained, will be a key factor in the cost reduction of the image processing algorithm that will be achievable without very expensive signal processing units.

REFERENCE SIGNS

10 sensor
12 sliding door
14 image generator
16 pattern
16*a* spot
18 detection area, ground
20 detector
20*a* camera
22 object
24 image processing unit
26 laser
28 first position
30 first point
32 second position
34 second point
36 points
38 lines
D distance
H height of the object
h1+h2 height of the sensor

The invention claimed is:

1. A sensor (10), comprising:
said sensor detecting presence in a detection area (18);
a pattern generator (14);
said pattern generator (14) projecting a pattern (16) on the detection area (18); said pattern generator (14) generates said pattern (16) on said detection area (18) having illuminated and non-illuminated zones; said pattern generator (14) generates pulsed patterns (16);
storing means for storing signals of a reference image pattern;
an image processing unit (24);
a camera (20) separated from the pattern generator (14) by a predetermined distance (D); said camera detecting signals of said pattern (16) reflected from said detection area (18); said camera (20) having a global shutter and a control unit; said control unit controls said shutter and said pattern generator (14) to synchronize the opening of said shutter with the pulse frequency of said pattern generator (14) to open said shutter with the beginning of said pattern pulse and to close said shutter at the end of said pattern pulse;
an object residing partially or wholly within said pattern;
said image processing unit (24) triangulating an object in said pattern (16) within said detection area (18); and, said image processing unit (24) comparing said reflected and received pattern (16) with said object present in said detection area with said signals of said reference image pattern stored in said storing means of said image processing unit (24).

2. Sensor according to claim 1, wherein said camera (20) includes a CCD or a CMOS chip.

3. Sensor according to claim 1 wherein said camera (20) comprises an optical input filter centered on the pattern generator wavelength to minimize the influence of ambient light on detection of said pattern (16) and/or said object.

4. Sensor according to claim 1, wherein said pattern (16) comprises at least one spot, said spot being a rectangular dots grid or a shifted dots grid to optimize the spatial power duty cycle.

5. Sensor according to claim 1, wherein said pattern generator (14) comprises a light source (26), and, said light source include a beam shaper.

6. Sensor according to claim 5, wherein said light source (26) generates wavelengths from 400 to 960.

7. Sensor according to claim 1, wherein said pattern (16) is generated by a set of single spot (16*a*) light sources that are positioned over said detection area (18), wherein each light source (26) resides a particular distance to the detector (20).

8. Sensor according to claim 5, wherein said light source (26) is a high power pulse laser (26) or a LED source.

9. Sensor according to claim 5, wherein said beam shaper is selected from the group consisting of diffractive optics, micro lenses arrays, and conventional anamorphic optics such as cylindrical lenses.

10. Sensor according to claim 1, further comprising: a multitude of pattern generators (14) wherein each said pattern is in a particular location and orientation relative to the detector (20).

11. A sensor (10) according to claim 1, wherein said sensor controls an automatic door opener and shutter.

12. Method for presence detection in a detection area (18), comprising the steps of:

generating, using at least one pattern generator (14), a pattern (16), on the detection area (18) having illuminated and non-illuminated zones;

generating pulsed patterns (16) using said pattern generator (14);

detecting, synchronously, said patterns (16) using a camera (20) on said detection area (18) as the global shutter of the camera (20) is opened when the pulsed pattern (16) is projected on said detection area (18);

detecting said pattern (16) on said detection area (18) using the camera (20), and generating output signals; and, comparing and triangulating, using an image processing unit (24), said output signals based on reflected and received pattern (16), with signals of a reference pattern stored in storing means of said image processing unit (24), to detect changes of said pattern (16) within said detection area (18) with respect to said reference pattern.

13. Method according to claim 12, further comprising the steps of:

detecting the absence of said pulsed pattern (16) on the detection area (18).

14. Method according to claim 13, further comprising the steps of:

comparing, using said image processing unit (24), said step of detecting, synchronously, said patterns (16) using said camera (20) on said detection area (18) as the global shutter of the camera (20) is opened when the pulsed pattern (16) is projected on the detection area (18) and said step of detecting the absence of the pulsed pattern (16) on the detection area (18), to filter out any ambient influence on the detection area (18).

15. Method according to any claim 14, wherein said step of detecting, synchronously, said patterns (16) using said camera (20) on said detection area (18) as the global shutter of the camera (20) is opened when the pulsed pattern (16) is projected on the detection area (18) includes a duty cycle, and said duty cycle of the transmit period is set to maximize source peak power and minimize ambient light integration time, avoiding saturation of camera pixels by said ambient light and increasing the signal to noise ratio.

16. Method according to any one of the claims 15, wherein said image processing unit (24) is repeatedly comparing accumulated data from said step of detecting, synchronously, said patterns (16) using said camera (20) on said detection area (18) as the global shutter of the camera (20) is opened when the pulsed pattern (16) is projected on the detection area (18) and from said step of detecting the absence of the pulsed pattern (16) on the detection area (18) to enhance signal to noise ratio.

17. Method according to any one of the claims 15, wherein said image processing unit (24) is repeatedly comparing accumulated data from said step of detecting, synchronously, said patterns (16) using said camera (20) on said detection area (18) as the global shutter of the camera (20) is opened when the pulsed pattern (16) is projected on the detection area (18) and from said step of detecting the absence of the pulsed pattern (16) on the detection area (18) to accumulate several immediate differences between said detecting steps.

18. Method according to claim 12, wherein said detection area (18) corresponds to a part or the whole field of view of a camera (20*a*) of the detector (20).

19. Method according to claim 12, further comprising the step of: storing a reference pattern in said wherein said sensor (10) starts with an activation step wherein a reference pattern is stored.

20. Method according to claim 12, further comprising the step of controlling an automatic door opener and shutter.

* * * * *

UNITED STATES PATENT AND TRADEMARK OFFICE

CERTIFICATE OF CORRECTION

PATENT NO. : 8,077,034 B2
APPLICATION NO. : 12/443181
DATED : December 13, 2011
INVENTOR(S) : Yves Borlez, Olivier Gillieaux and Christian Leprince It is certified that error appears in the above-identified patent and that said Letters Patent is hereby corrected as shown below:

Col. 10, line 36, after "pattern in said" delete "wherein said".

Signed and Sealed this
Thirty-first Day of January, 2012

David J. Kappos

David J. Kappos
*Director of the United States Patent and Trademark Office*